US005466079A

United States Patent [19]

Quintana

[11] Patent Number: 5,466,079

[45] Date of Patent: Nov. 14, 1995

[54] APPARATUS FOR DETECTING MEDIA LEADING EDGE AND METHOD FOR SUBSTANTIALLY ELIMINATING PICK SKEW IN A MEDIA HANDLING SUBSYSTEM

[75] Inventor: Jason Quintana, Vancouver, Wash. 98684

[73] Assignee: Hewlett-Packard Company, Palo Alto, Calif.

[21] Appl. No.: 379,238

[22] Filed: Jan. 27, 1995

[51] Int. Cl.[6] ..... B41J 11/55

[52] U.S. Cl. ..... 400/579; 400/630; 400/708; 271/227

[58] Field of Search ..... 400/708, 579, 400/633, 624, 630, 608.3, 632.1, 709, 708.1; 271/227, 228, 233, 256

[56] References Cited

U.S. PATENT DOCUMENTS

| | | | |
|---|---|---|---|
| 4,738,442 | 4/1988 | Rodi | 271/227 |
| 4,984,778 | 1/1991 | Alexander | 271/226 |
| 5,035,415 | 7/1991 | Lee | 271/227 |
| 5,062,726 | 11/1991 | Inomata | 400/579 |
| 5,140,166 | 8/1992 | Gerlier | 271/227 |
| 5,226,741 | 7/1993 | Kumazaki | 400/579 |

FOREIGN PATENT DOCUMENTS

| | | | |
|---|---|---|---|
| 1218865 | 9/1989 | Japan | 400/579 |
| 2243376 | 9/1990 | Japan | 400/579 |
| 3002078 | 1/1991 | Japan | 400/578 |

*Primary Examiner*—Edgar S. Burr
*Assistant Examiner*—Steven S. Kelley

[57] ABSTRACT

A media handling subsystem picks a media sheet from a stack, then moves the picked sheet along a media path. Any skewing of the media sheet existing in the media stack or occurring during the pick cycle is removed before the sheet reaches a position to receive print markings. In particular, the alignment of the skewed media sheet is altered (i.e., the sheet is moved) to square the media sheet to the media path. An electro-optic sensor detects when the top of a media sheet enters between a drive roller and pinch roller. Upon entering, the media sheet moves a mechanical flag into the light circuit of the optical sensor. After the media sheet trips the flag, the drive roller moves the top edge of the media sheet backward along the media path out of the grasp of the pinch roller and drive roller. As the sheet moves out of the grasp, the top edge of the sheet falls into squared alignment with the drive roller and pinch roller. The squared media sheet then is moved forward tripping the flag again. The drive roller then pulls the sheet along the media path into the path of the optical sensor so that the optical sensor detects the top of the page. The sensor then is shuttled to scan for a side of the page. With the top of page and side of page known, and with it known that the page is squared to the media path, markings are placed accurately on the media sheet.

11 Claims, 6 Drawing Sheets

APPARATUS FOR DETECTING MEDIA LEADING EDGE AND METHOD FOR SUBSTANTIALLY ELIMINATING PICK SKEW IN A MEDIA HANDLING SUBSYSTEM

CROSS REFERENCE TO RELATED APPLICATIONS

This invention is related to U.S. patent application Ser. No. 08/146,516 filed Nov. 1, 1993 for Shuttle-Type Printers and Methods for Operating Same. The content of that application is incorporated herein by reference and made a part hereof.

BACKGROUND OF THE INVENTION

This invention relates generally to methods for eliminating pick skew in a media handling subsystem, and more particularly, to a method for squaring a page at a drive roller using information sensed by a single emitter-detector pair.

A media handling subsystem transports a media sheet through a printing device, such as a computer printer, fax machine or copy machine. The media sheet is picked from a stack, then moved along a media path using one or more sets of rollers. Along the path the media sheet is positioned adjacent to a printhead which generates character or graphic markings on the media sheet. For proper placement of the markings, the position and alignment of the media sheet are known.

One source of misalignment occurs during a pick cycle. A pick cycle encompasses the steps of picking a single sheet from a stack of media sheets and moving the sheet away from the stack along a media path. For example, a pick roller often is used to drive a media sheet into one or more corner separators. Corner separators are flaps located on one or both leading corners of a media stack. The pick roller exerts a drive force causing a buckle in affected corners of the media sheet, allowing the sheet to pop over the corner separators and move forward. The drive force, however, is insufficient to create a buckle in underlying sheets, so that the top sheet is picked and moves past the underlying sheets. According to another example, a pick roller drives a media sheet into a separator pad. A separator pad is a friction pad into which a leading edge of the media sheet is driven. The pick roller exerts sufficient drive force for the top sheet to overcome the friction drag of the separator pad and move forward. The drive force on the underlying sheets, however, is insufficient to overcome the drag. Thus, the top sheet is picked and moves past the underlying sheets.

As the media sheet pops forward to separate from the stack, the media sheet may skew. This is referred to as pick skew. As the media sheet moves along the media transport path the rollers urging the sheet forward may cause additional skew. This additional skew is referred to as feed skew. The pick skew and feed skew, together with skew in the stack itself, are referred to as media skew.

If a media sheet is skewed, then the printout onto the media sheet will not be square to the page. The result is an aesthetically displeasing output alignment. One approach for addressing such problem is to detect media skew, then compensate for the skew when applying markings to the page. In effect the placement of markings is skewed an amount comparable to the media skew. As a result, the markings are placed square to the page—an aesthetically pleasing output alignment. A method for detecting such media skew is described in the above-referenced patent application, incorporated herein by reference. Compensating for media skew, however, places a burden on the print throughput. Markings from more than one line, for example, may have to be managed. As the page per minute print speed of a device increases such burden becomes significant. Accordingly, there is a need for another approach for handling skew. As pick skew and stack skew are substantial components of media skew, and because feed skew typically is insignificant, this invention addresses the problem of stack skew and pick skew.

SUMMARY OF THE INVENTION

According to the invention, stack skew and pick skew of a media sheet are substantially eliminated before the media sheet receives print markings. A media handling subsystem picks a media sheet from a stack, then moves the picked sheet along a media path. Any skew of the media sheet in the stack or skew occurring during the pick cycle is removed before the sheet reaches a position to receive print markings. In particular, the alignment of the skewed media sheet is altered (i.e., the sheet is moved) to square the media sheet to the media path. The media sheet then is fed into position for receiving print markings.

According to one aspect of the invention, an electrooptic sensor detects when the top of a media sheet enters between a drive roller and pinch roller of a media transport subsystem. In particular, the media sheet moves a mechanical flag just prior to entering, or as it enters, between the drive roller and the pinch roller. The mechanical flag is moved into the light circuit of the optical sensor. In effect, the media sheet trips the flag.

According to another aspect of the invention, after the media sheet trips the flag, the media sheet is squared. To do so, the drive roller moves the top edge of the media sheet backward along the media path out of the grasp of the pinch roller and drive roller. As the sheet moves out of the grasp, the top edge of the sheet falls into squared alignment with the drive and pinch roller.

According to one embodiment for squaring the media sheet, while the "pinch" roller or drive roller is moving the top edge of the media sheet backwards, a "pick" roller maintain the trailing portion of the media sheet in a fixed position. Thus, the media sheet buckles as it moves back. With the media sheet out of the grasp of the drive roller, the buckling is forcing the top edge to align squarely with the drive roller and pinch roller. The drive roller then rotates forward, drawing the leading edge in square. The pick roller then releases pressure on the media sheet causing the trailing portion of the media sheet to fall into alignment with the squared top edge.

According to another embodiment, the media path is angled so the media sheet travels downward from a pick position to the drive roller pinch roller entry point. When the pinch roller or drive roller pushes the media sheet backwards out of the grasp of the drive roller, gravity works upon the media sheet to bias the top edge toward the drive roller pinch roller entry point. In this embodiment the trailing edge is not held in position. Thus, gravity works upon the unrestrained media sheet causing the top edge to fall into squared alignment with the drive roller and pinch roller.

According to another aspect of the invention, the squared media sheet then is moved forward tripping the flag again. The drive roller pulls the sheet along the media path into the path of the optical sensor. Thus, the optical sensor detects the top of the page.

According to another aspect of the invention, the optical sensor is mounted on a shuttle carriage which scans a printhead back and forth across a page to apply markings. Prior to printing, the carriage is moved into position for detecting when the mechanical flag is tripped. Once the media sheet is squared, then the flagged tripped again, the sensor detects the top of the page as the page moves along the media path. Because the squaring process may offset the page sideward, the sensor then is shuttled to scan for a side edge of the page. With the top of page and side of page known, and with it known that the page is squared to the media path, markings can be placed accurately on the media sheet. In one embodiment, the sensor is shuttled to capture additional points, such as another point along the top edge to confirm precise squaring of the page and/or one or more readings on each of the side edges of the page.

According to another aspect of the invention, the mechanical flag is used to indicate that a hand fed sheet is present. In one embodiment the mechanical flag is positioned just prior to the pinch roller. In addition, the sensor is stored in a position for detecting the flag. A user manually feeding a single sheet (i.e., hand-fed) trips the flag as the user pushes the sheet toward the drive roller and pinch roller. The sensor detects the tripped flag. Because a print cycle has yet to begin, the print processor determines that the flag is tripped by a hand fed sheet rather than a sheet picked from a stack. Thus, when the print cycle is initiated by a host computer, the printer knows that the hand-fed sheet is present.

One advantage of the invention is pick skew is substantially eliminated. A benefit of such elimination is that pick skew need not be compensated for when placing markings onto the media sheet. Such compensation would otherwise be processing overhead impacting printout throughput. Another advantage of this invention is that skew is detected during the pick cycle using a single emitter-detector pair, thereby saving the cost of additional emitter-detector pairs used in prior approaches.

These and other aspects and advantages of the invention will be better understood by reference to the following detailed description taken in conjunction with the accompanying drawings.

DESCRIPTION OF SPECIFIC EMBODIMENTS

Overview

Figure 1:
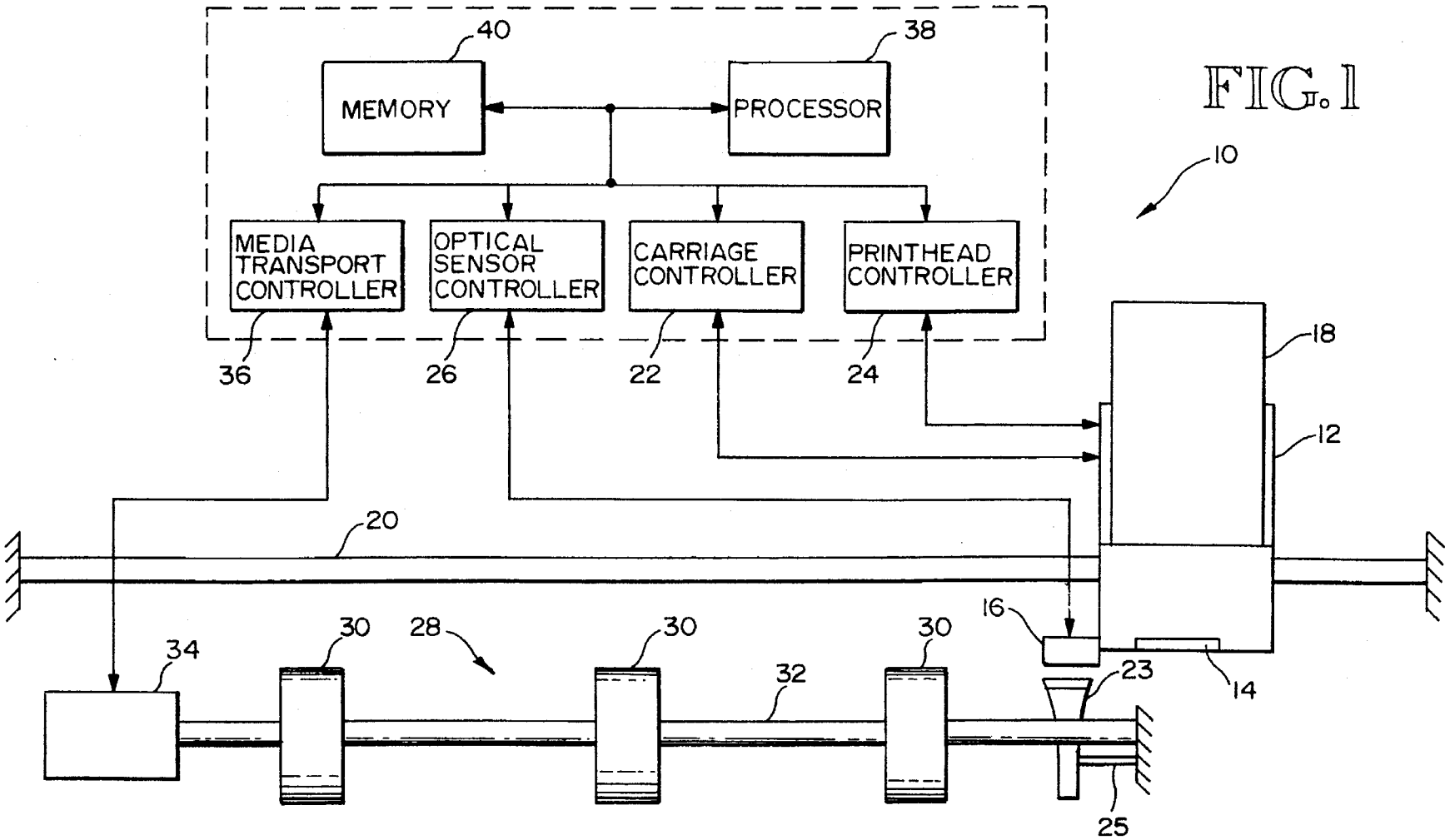
FIG. 1 is a diagrammatic illustration of a printing apparatus for implementing an embodiment of the method of this invention.

FIG. 1 shows part of a print apparatus 10 implementing a method for substantially eliminating pick skew according to one embodiment of this invention. Shown is a shuttle carriage 12 for carrying a printhead 14 and optical sensor 16. In alternate embodiments the print apparatus 10 is part of a computer printer, fax machine, or copy machine. In a specific embodiment, shuttle 12 carries an inkjet pen body 18, although other printhead types may be used. The shuttle 12 is driven along a rail 20 based upon input from a carriage controller 22. As the shuttle scans across a page, the printhead 14 prints markings onto a media sheet under the control of a printhead controller 24. In addition, an optical sensor controller 26 samples the optical sensor 16 for determining paper position, carriage location and other information. A lever "flag" 23 rotates about an axis 25 to enter the path of the optical sensor 16 during a pick cycle.

Also shown is a drive roller 26 including multiple elastomeric "tires" 30 and a rotating shaft 32. The drive roller 28 is driven by a motor 34 based on commands from a media transport controller 36. The various controllers 22, 24, 26, 36 are in communication with a print processor 38 and memory 40.

Figure 2:
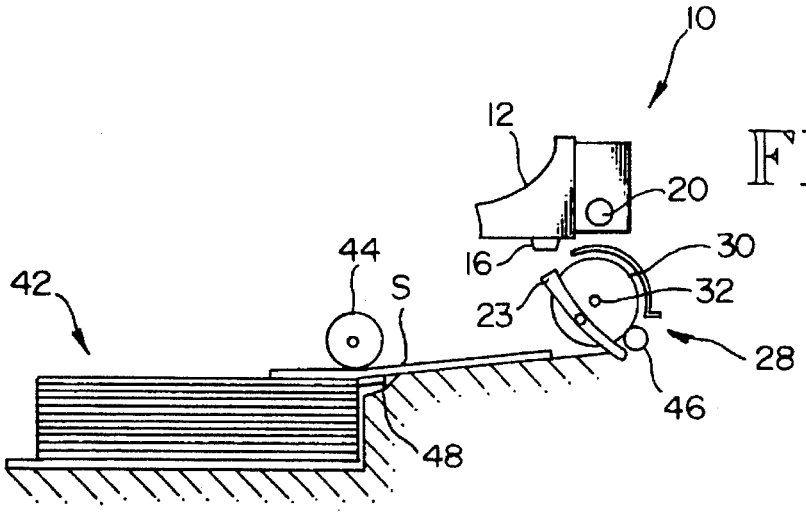
FIG. 2 is a diagram of a media feed path within a media transport subsystem of the apparatus of FIG. 1.

Referring to FIG. 2, the print apparatus 10 includes a media transport subsystem for picking a media sheet S from a media stack 42. Alternatively, the media sheet S is fed manually by a user one sheet at a time. The transport subsystem includes the drive roller 28, motor 34 and media transport controller 36, along with a pick roller 44 and pinch roller 46. During operation, a media sheet S is picked from the stack 42, then fed along a media path through the print apparatus 10 to receive print markings. In an alternate embodiment of the media transport subsystem, the pick roller 44 is omitted. In such embodiment, the media sheet S is fed downward at an angle to the drive roller 28.

Media Pick Cycle

In the embodiment shown in FIG. 2 a pick roller drives one or more media sheets into a separator pad 48. The pick roller 44 exerts sufficient drive force on the top sheet S, that it overcomes the friction drag of the separator pad 48 and moves forward. The drive force on the underlying sheets, however, is insufficient to overcome the drag. Thus, the top sheet S is picked and moves past the underlying sheets. Various pick structures and methodologies may be used, however, as would be appreciated by one of ordinary skill in the art.

Figure 3:
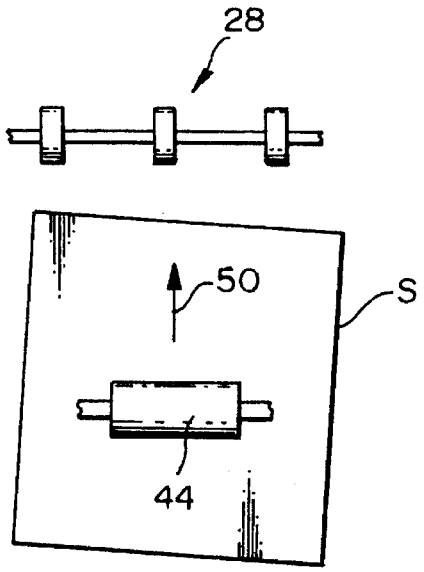
FIG. 3 is a diagram of a media sheet exhibiting pick skew relative to a media path.

A problem with some pick structures is that the media sheet S tends to pop forward or skew relative to the stack 42 and media path. FIG. 3 depicts a media sheet S skewed relative to a direction 50 defined by the media path. The degree of skew is exaggerated for illustrative clarity. Structures which cause little if any skew are conventionally available, but are mechanically more complex and thus, more costly, than many conventional devices that cause skew or require well oriented stacks. One of the benefits of this invention is that the less costly pick structures can be used to pick jumbled stacks, (i.e., sheets within the stack may be offset longitudinally, laterally and/or rotationally from each other and relative to the media path). The stack skew and resulting pick skew is removed according to various embodiments of the method of this invention.

For a hand fed sheet S, occasionally the sheet is fed in skewed. Another benefit of this invention is that skew in a hand fed sheet also is removed according to various embodiments of the method of this invention.

Method for Eliminating Pick Skew

Figure 4:
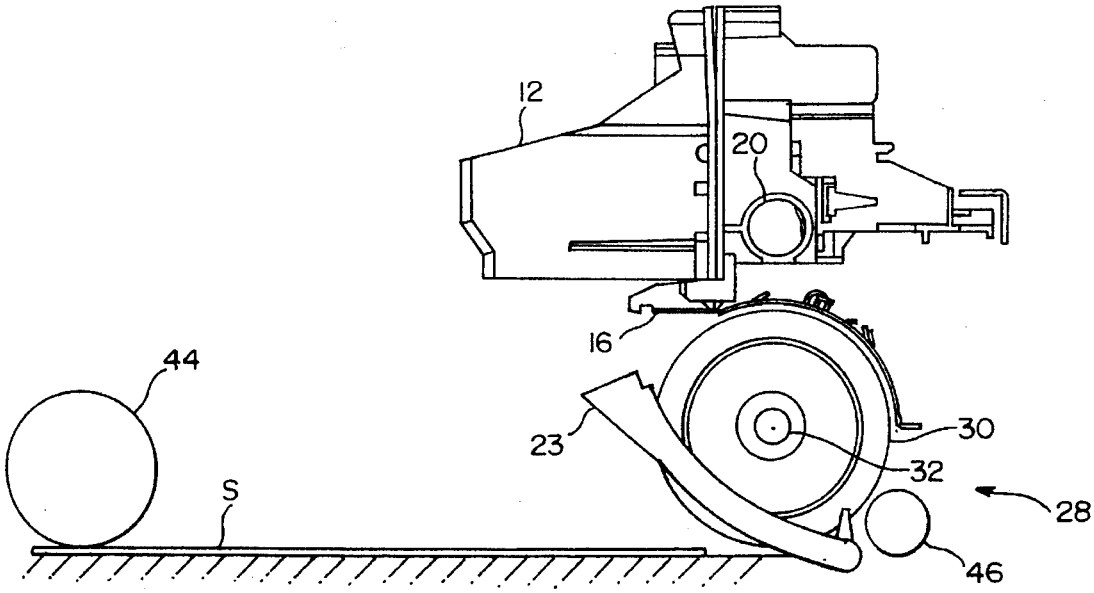
FIG. 4 is an illustration of a picked media sheet entering the area of a drive roller for a flatbed media path embodiment with a pick roller.
Figure 5:
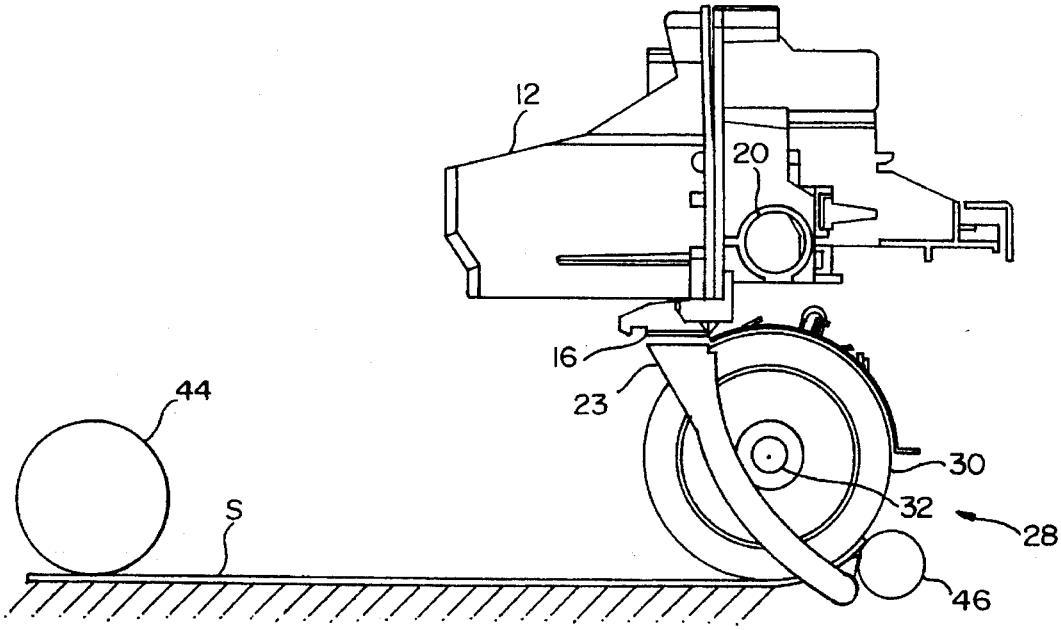
FIG. 5 is an illustration of a picked media sheet having moved a lever flag into the path of an optical sensor for the embodiment of FIG. 4.

Referring to FIG. 2 and FIGS. 4–7, a method for substantially eliminating pick skew is shown according to a specific embodiment of this invention. Sheet S is picked from a stack 42 or fed as a single sheet into the media path of the print apparatus 10. The sheet S is driven forward toward a drive roller 28 by the pick roller 44. FIG. 4 shows the media sheet S about to enter the pull of the drive roller 28. As the media sheet is pulled into the drive roller, the sheet S encounters the lever flag 23. The forces from the pick roller 44 and or drive roller 28 push the paper into lever 23 causing lever 23 to rotate. Either just before, just after or as sheet S reaches pinch roller 46 (See FIG. 5), lever 23 has been rotated into the light circuit of the optical sensor 16. In effect, sheet S trips the lever flag 23 so that the optical sensor registers the flag just prior to (e.g., 1 mm before), just after or at the time the sheet impinges upon pinch roller 46, according to the embodiment. The paper then enters between the drive roller 28 and pinch roller 46 and travels for a short distance before the rollers stop driving the sheet S. In a specific embodiment, the sheet S is driven only a few millimeters (e.g., 3 mm.) before the drive action ceases. The distance that the sheet S is moved beyond the pinch roller 47 is at least as long as the path distance differential between the two top corners of a skewed sheet S. For example, if sheet S is skewed by n degrees, then one top corner of sheet S will be a specific distance farther along the media path than the other top corner. For the maximum expected skew, the corresponding specific distance or slightly longer is the prescribed amount that sheet S should be advanced beyond the pinch roller 46.

Figure 6:
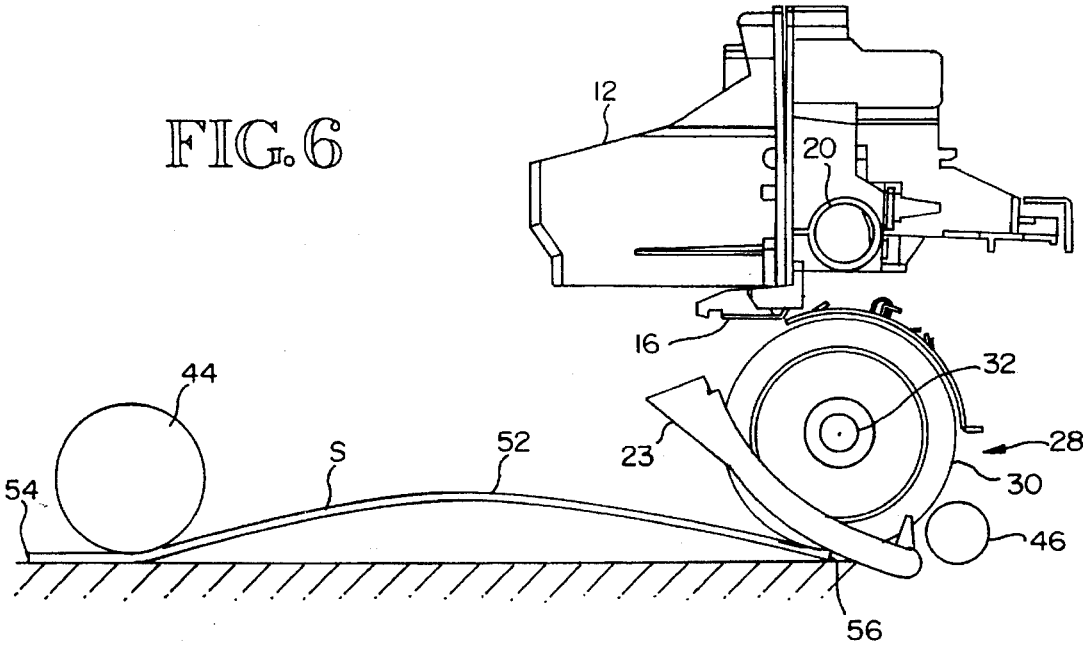
FIG. 6 is an illustration of a picked media sheet forced back along the media path while its trailing portion is held by the pick roller for the embodiment of FIG. 4.
Figure 7:
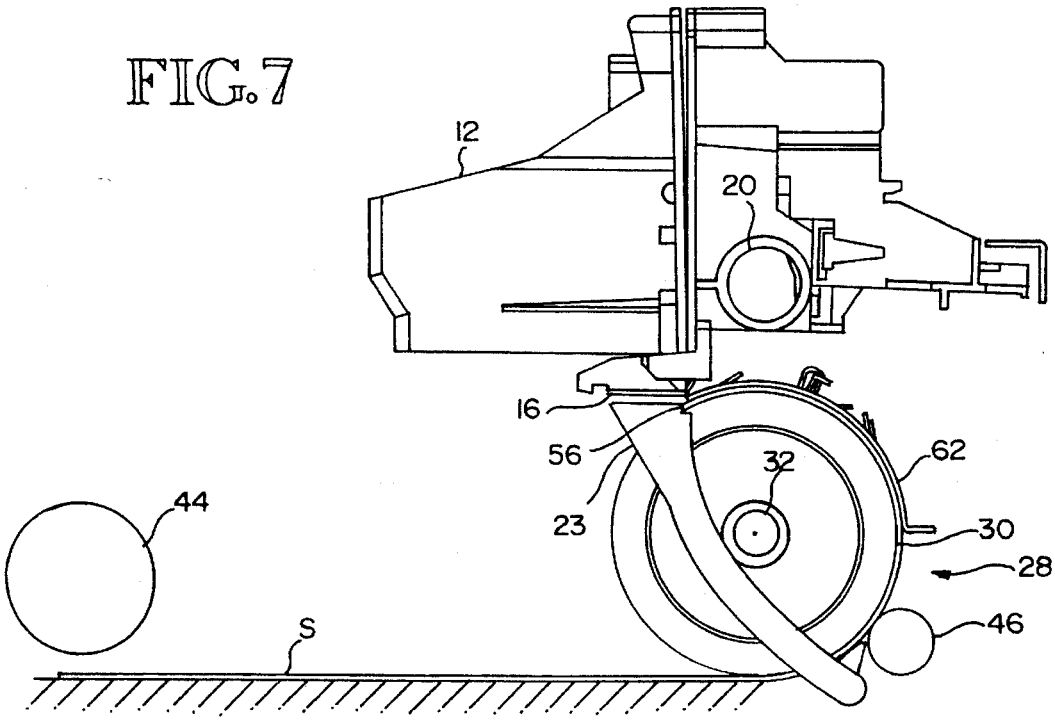
FIG. 7 is an illustration of a squared media sheet having a top edge detected by the optical sensor.

Once the forward drive action ceases, the drive roller 28 begins a backward drive action onto the sheet S. While sheet S is driven backward, however, the pick roller 44 maintains stationary and in forced contact with the sheet S. Thus, the top portion 62 of sheet S is moved backward along the media path, while the trailing portion 54 is held stationary. As a result, the sheet buckles as shown in FIG. 6. The backward drive action continues for a prescribed rotational distance sufficient for the sheet S to escape the grasp of the pinch roller 46. Even though out of the pinch roller grasp, the buckling action biases the top portion 52 and in particular the lead edge 56 into the drive roller 28. Such buckling force is sufficient for the leading edge 56 to be forced flush with each of the tires 30 of the drive roller 28. Thus, the leading edge 56 is square to the drive roller 28 and thus to the media path.

The drive roller 28 then rotates forward drawing in the leading edge of sheet S, and shortly thereafter, the pick roller 44 releases pressure on the trailing portion 54. Thus, the trailing portion of sheet S relaxes into a squared alignment with the top edge and media path. Thus, pick skew is eliminated. The drive roller continues forward rotation pulling the sheet S into the pinch roller 46. The sheet trips the flag 23 again and the sensor thus detects the location of the leading edge of the squared sheet. This time the drive roller 28 continues pulling the sheet S around the drive roller 28 adjacent to a paper guide 62.

As the sheet is pulled around the drive roller, the top edge 56 of the sheet S enters into the light path of the optical sensor 16. The optical sensor 16 thus senses the top edge of the sheet S. Because the squaring process may offset the sheet S laterally along the roller, the sensor S is shuttled with the carriage 12 by the carriage controller 22 to sense a side edge of the sheet. With a point on top edge known, a point on the side edge known, and it known that the sheet S is square, markings can be placed accurately on the sheet S. According to other embodiments, one or more additional points are detected along the top edge and side edge to assure that the sheet S is square and to detect any feed skew that may be present.

Alternative Squaring Technique

Figure 8:
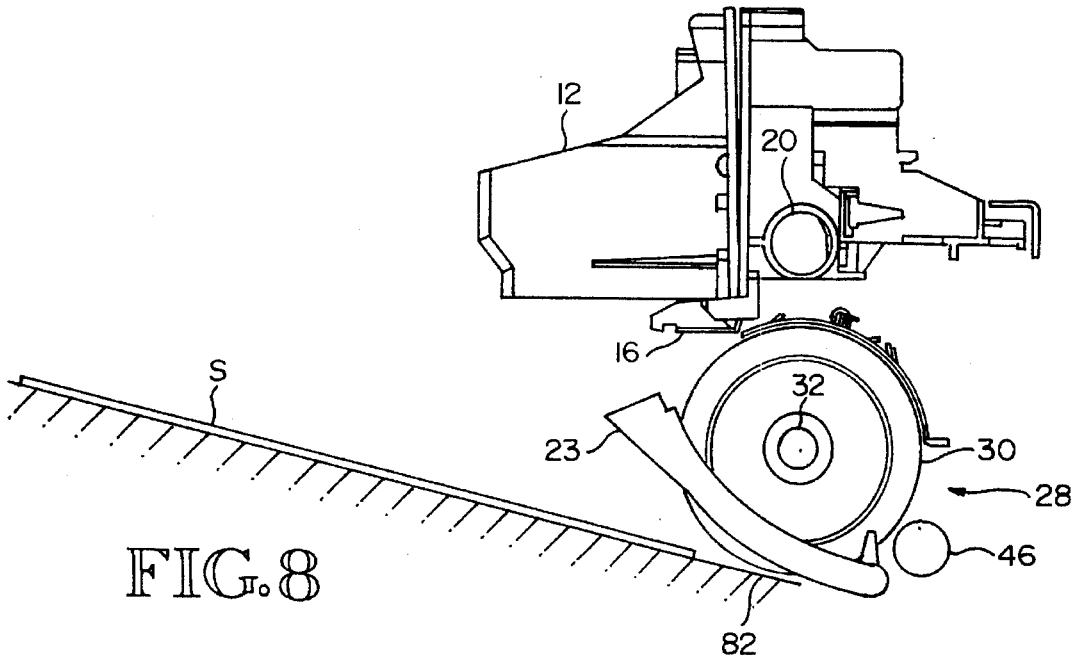
FIG. 8 is an illustration of a picked media sheet entering the area of a drive roller for an angled flatbed media path embodiment.
Figure 9:
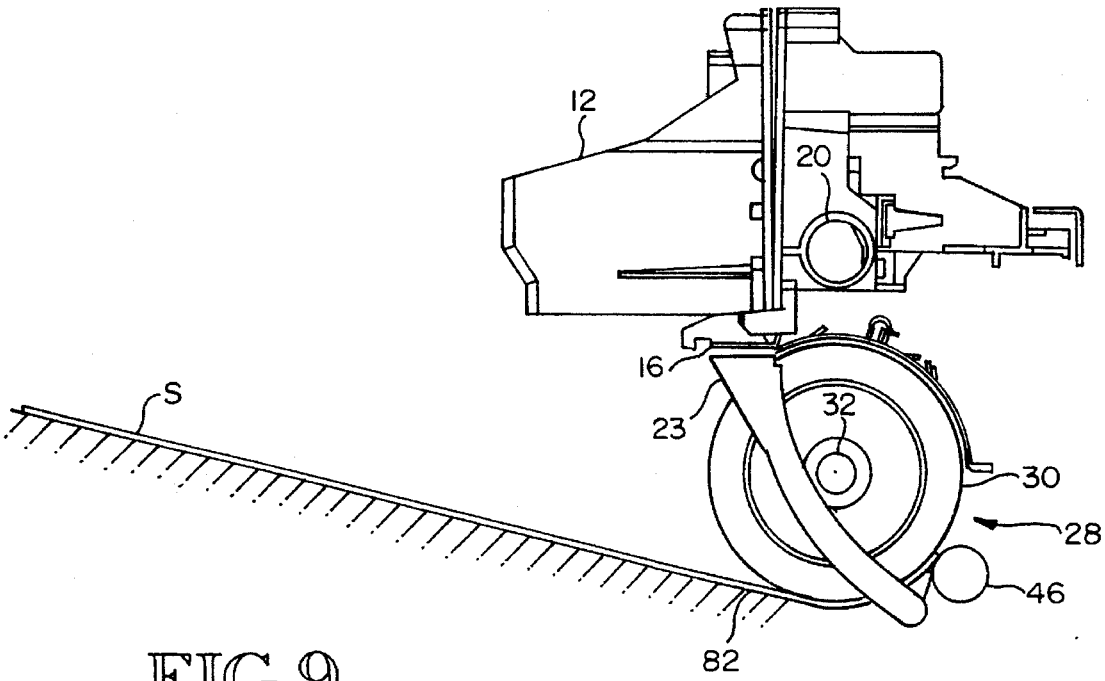
FIG. 9 is an illustration of a picked media sheet having moved a lever flag into the path of an optical sensor for the embodiment of FIG. 8.
Figure 10:
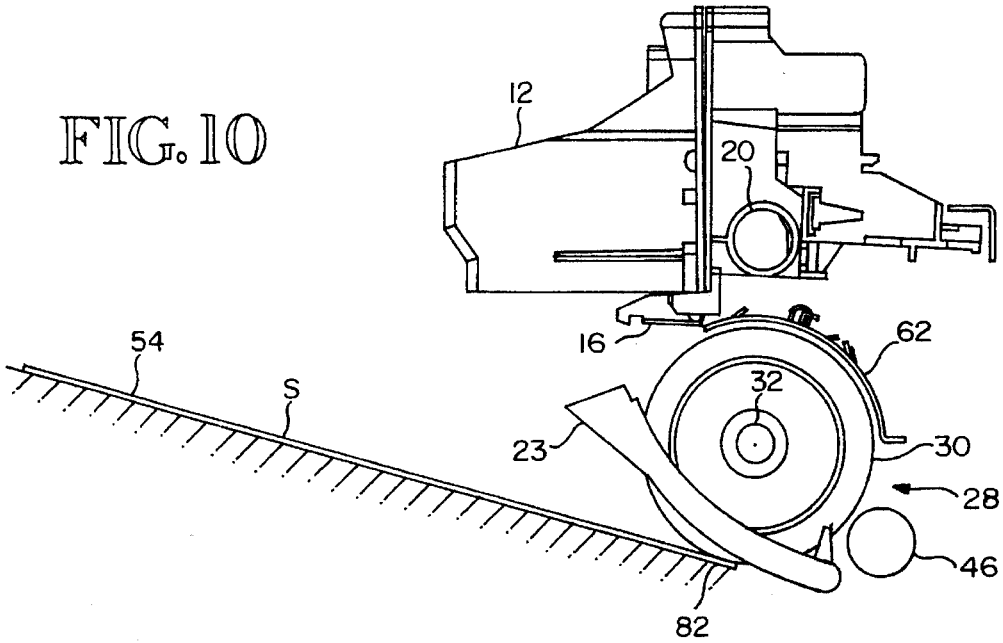
FIG. 10 is an illustration of a picked media sheet forced back along the media path to rest square to the drive roller for the embodiment of FIG. 8.
Figure 11:
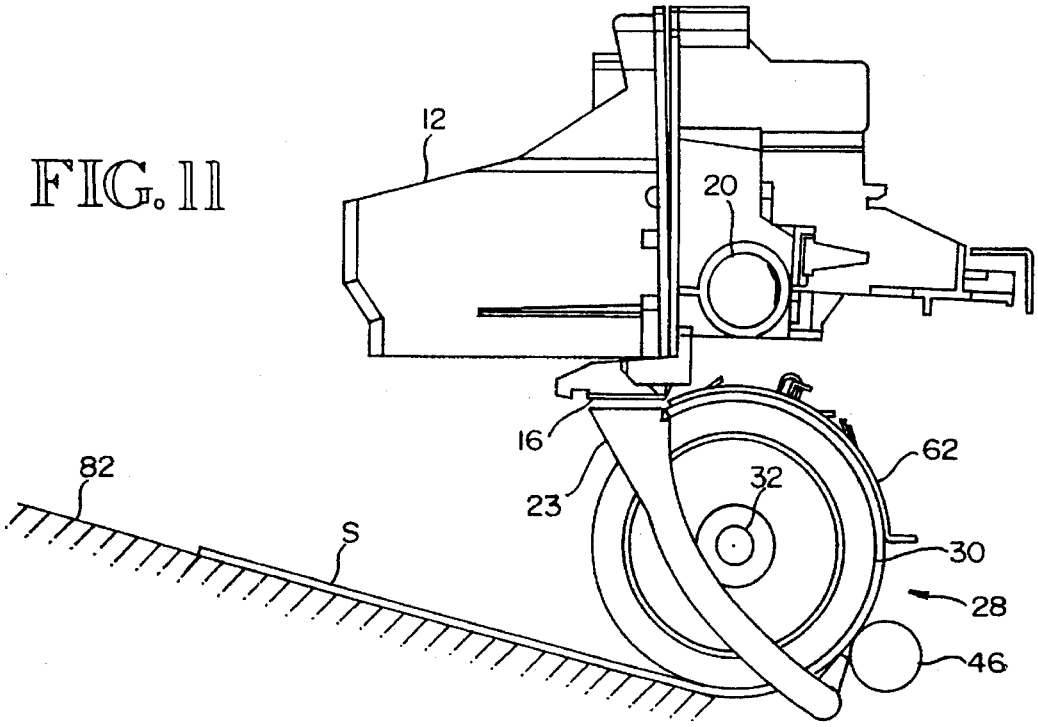
FIG. 11 is an illustration of a squared media sheet having a top edge detected by the optical sensor for the embodiment of FIG. 8.

FIGS. 8–11 depict an alternate media handling subsystem in which the media sheet is fed downward at an angle into the drive roller 28. A single sheet S is fed or is picked from a stack and guided along a ramp 82 toward the drive roller 28. Typically, a separator pad is pressed to the media sheet as it is picked and moved forward to the drive roller. FIG. 8 shows the media sheet S about to enter the pull of the drive roller 28. Just prior to, just after or as the media sheet S is pulled into the drive roller, the sheet S encounters the lever flag 23, according to the specific embodiment. A force applied by the drive roller 28 pushes the paper into lever 23 causing lever 23 to rotate. When sheet S reaches pinch roller 46 (See FIG. 9), lever 23 has been rotated into the light circuit of the optical sensor 16. In effect, sheet S trips the lever flag 23 so that the optical sensor registers the flag at the time the sheet impinges upon pinch roller 46. The paper then enters between the drive roller 28 and pinch roller 46 and travels for a short distance before the rollers stop driving the sheet S. In a specific embodiment, the sheet S is driven only a few millimeters (e.g., 3 mm.) before the drive action ceases. The distance that the sheet S is moved beyond the pinch roller 47 is at least as long as the path distance differential between the two top corners of a skewed sheet S. Along the way the separator pad releases the media sheet.

Once the forward drive action ceases, the drive roller 28 begins a backward drive action onto the sheet S. The drive roller 28 forces the sheet S backward up the ramp 82 out of the grasp of the pinch roller 46. As the sheet S is driven backward, there is no restraint on the trailing portion 54 of the sheet. Due to the incline, the sheet S settles square to the drive roller 28 under the forces of gravity. According to such approach, the ramp 82 is sufficiently smooth and sufficiently inclined for gravity to force the top portion of the sheet to settle square to the drive roller 28, and thus, to the media path.

With the sheet S squared, the drive roller then begins forward rotation once again pulling the sheet S into the pinch roller 46. The sheet trips the flag 23 again, but this time the drive roller 28 continues pulling the sheet S around the drive roller 28 adjacent to a paper guide 62.

As the sheet is pulled around the drive roller 28, the top edge 56 of the sheet S enters into the light path of the optical sensor 16. The optical sensor 16 thus senses the top edge of the sheet S. The sensor S then is shuttled with the carriage 12 under control of carriage controller 22 to sense a side edge of the sheet. With a point along the top edge known, a point along the side edge known, and it known that the sheet S is square, markings can be placed accurately on the sheet S. According to other embodiments, one or more additional points are detected along the top edge and side edge to assure that the sheet S is square and to detect any feed skew that may be present.

Method for Detecting Hand Fed Sheet

For an embodiment in which the flag 23 is positioned just prior to the pinch roller 46, a user manually feeding a single sheet (i.e., hand-fed) causes the flag 23 to trip even though a print cycle has not begun. According to such method the carriage 12 is stored in a position for the sensor 16 to detect the flag 23. The user feeds the sheet S along a hand-fed path blocked by the pinch roller 46. As the sheet is fed in the flag 23 is tripped. Sensor 16 detects the tripped flag 23. Because a print cycle has yet to begin, the print processor determines that the flag is tripped by a hand fed sheet rather than a sheet picked from a stack. Thus, when the print cycle is initiated by a host computer, the printer knows that the hand-fed sheet is present. The printer does not require an additional computer command to instruct the printer to await for a hand-fed sheet.

Optical Sensor

The optical sensor 16 includes a light source and a light detector. Exemplary light sources include a photoemitter, LED, laser diode, super luminescent diode, or fiber optic source. Exemplary light detectors include a photodetector, charged couple device, or photodiode. The light source is oriented to emit a light beam in a specific direction relative to the carriage 12. The light detector is aligned to detect light reflected from the tripped flag 23 or a sheet S adjacent to the sensor 16. The sensor 16 serves multiple functions during operation. As described above, the sensor detects the when a media sheet S encounters the pinch roller by sensing the tripped lever 23. The sensor 16 also detects points along the top and side edges of the page for assuring the paper is squared and/or for providing skew information as the sheet is printed on. The sensor also detects the trailing edge of the page to signify when printing to the page is over. In addition to these media pick and feed functions, the sensor also can provide other functions such as detecting the position of the carriage 12, and the pagewidth.

Lever Flag

Lever flag 23 is biased to a first position in which it does not close the light circuit between optical emitter and optical detector. In one embodiment, the lever is mounted so that gravity biases it to the first position. In another embodiment, the lever 23 is spring-biased to the first position. The biasing force (e.g., gravity, spring tension) is minimal, however, so that a sheet moving under a drive force can tip the lever 23 and push it into a tripped "second" position in which it closes the light circuit for sensor 16. The lever 23 is made of conventional lightweight materials used in other print apparatus components as would be appreciated by one of ordinary skill in the pertinent art. Although a rotatable lever is described to embody the flag 23, other mechanical structures responding to the media sheet to move between a first position and a second position also may be used.

Meritorious and Advantageous Effects

One advantage of the invention is pick skew is substantially eliminated. A benefit of such elimination is that pick skew need not be compensated for when placing markings onto the media sheet. Such compensation would otherwise be processing overhead impacting printout throughput. Another advantage of this invention is that skew is detected during the pick cycle using a single emitter-detector pair, thereby saving the cost of additional emitter-detector pairs used in prior approaches.

One of the benefits of this invention is that less costly pick structures (e.g., that introduce pick skew) can be used. Another benefit is that jumbled stacks having misaligned sheets can be used without compromising print placement. The pick skew that results is removed according to various embodiments of the method of this invention.

Although a preferred embodiment of the invention has been illustrated and described, various alternatives, modifications and equivalents may be used. For example, Therefore, the foregoing description should not be taken as limiting the scope of the inventions which are defined by the appended claims.

What is claimed is:

1. A method for substantially eliminating pick skew in a media handling subsystem, comprising the steps of:

actuating a media pick cycle during which a media sheet is picked and moved toward a first roller along a media path;

detecting with an optical sensor that a leading edge of the picked media sheet has reached a known position;

backing the media sheet out from the first roller;

squaring the media sheet relative to the media path;

moving the squared media sheet back upon the first roller;

detecting with the optical sensor a top edge of the squared media sheet;

detecting with the optical sensor a side edge of the squared media sheet; and feeding the squared media sheet into position for receiving print markings.

2. The method of claim 1, in which the optical sensor is movable for performing the leading edge, top edge and side edge detecting steps while positioned at other than a single common location.

3. The method of claim 1, in which the step of detecting the leading edge comprises the step of:

moving a mechanical lever with the media sheet into a position at which the lever is detectable by the optical sensor.

4. The method of claim 1 in which the step of backing the media sheet comprises the step of:

holding a trailing portion of the media sheet fixed while the media sheet is backed out from the first roller; and in which the step of squaring the media sheet comprises the steps of:

buckling a lead portion adjacent said leading edge of the media sheet forcing the leading edge to align squarely with the first roller; and releasing the trailing edge of the media sheet causing the trailing portion of the media sheet to fall into alignment with the squared top edge.

5. The method of claim 1, in which the step of actuating a pick cycle comprises the step of moving the media sheet downward toward the first roller;

in which the step of backing the media sheet comprises the step of backing the media sheet out from the first roller into an unrestrained position; and in which for the step of squaring the media sheet, gravity works upon the unrestrained media sheet causing the media sheet to move into squared alignment with the first roller.

6. An apparatus for detecting a leading edge of a media sheet along a media path to eliminate pick skew, comprising:

an optical sensor movable in a direction generally orthogonal to the media path to sense the leading edge and a side edge of the media sheet;

a drive roller for receiving the media sheet and driving the media sheet along the media path in both forward and reverse directions;

a pinch roller for pressing the media sheet to the drive roller;

a mechanical flag movable between a first position blocking the media path and a second position for responding to the optical sensor, wherein a media sheet moving along the media path moves the flag from the first position to the second position triggering the optical sensor to indicate that a leading edge of the media sheet has reached a known position along the media path;

wherein pick skew is eliminated by backing the media sheet along the media path after the optical sensor detects the leading edge has reached a known position, squaring the media sheet relative to the media path, and moving the squared media sheet back to the drive roller and pinch roller; the optical sensor detecting the leading edge and side edge of the squared media sheet.

7. The apparatus of claim 6, in which the mechanical flag has a first end for blocking the media path while in the first position, and in which the flag is rotatable so that a second end triggers the optical sensor when the flag is in the second position.

8. The apparatus of claim 6, in which the flag is biased to the first position by gravity.

9. The apparatus of claim 6, in which the flag is spring-biased to the first position.

10. The apparatus of claim 6, in which the mechanical flag is a rotatable lever having a first end biased into the media path to define the first position and having a second end at which the second position is detected by the optical sensor to indicate that a leading edge of the media sheet has reached a known position.

11. The apparatus of claim 6, in which the mechanical flag responds to a hand-fed media sheet to move into a second position for indicating a hand-fed sheet is awaiting action along the media path.

* * * * *